United States Patent [19]

Tamarin

[11] 4,015,770

[45] Apr. 5, 1977

[54] PACKAGING

[76] Inventor: Bernard J. Tamarin, The Philadelphian, 1C 41, 2401 Pennsylvania Ave., Philadelphia, Pa. 19130

[22] Filed: July 24, 1975

[21] Appl. No.: 598,699

[52] U.S. Cl. ..... 229/51 C; 53/14

[51] Int. Cl.[2] ..... B65D 17/16

[58] Field of Search ..... 53/14, 133; 93/12 C; 206/264; 229/51 C, 87 C, 51 AS

[56] References Cited

UNITED STATES PATENTS

| | | | |
|---|---|---|---|
| 1,468,333 | 9/1923 | Thom | 53/14 |
| 1,884,545 | 10/1932 | Boutin | 206/264 X |
| 1,915,503 | 6/1933 | Schmidt | 206/264 X |
| 1,978,035 | 10/1934 | Thom | 53/133 X |
| 2,456,059 | 12/1948 | Grupe | 53/3 X |
| 2,603,925 | 7/1952 | Moore | 53/234 X |
| 2,815,620 | 12/1957 | Prodigo | 53/137 X |
| 2,822,120 | 2/1958 | Tamarin | 229/51 TC |
| 2,844,298 | 7/1958 | Tamarin | 229/51 C |
| 2,923,110 | 2/1960 | Tamarin | 53/14 |
| 3,402,877 | 9/1968 | Pinkham | 206/264 |

*Primary Examiner*—Travis S. McGehee
*Assistant Examiner*—J. Sipos
*Attorney, Agent, or Firm*—Charles A. McClure

[57] ABSTRACT

Cigarette packages are provided with individual pull tabs by applying a strip of pull material to access end surfaces of such packages in sequence and then severing the strip between adjacent packages. Before application of the pull material, each such access end surface is slitted substantially from side to side thereof, and after being applied thereto the pull material covers the slitted part of such an end surface and seals the slit therein. Removal of such a pull tab by pulling upon a non-adherent marginal portion thereof removes the underlying portion of an outer sheath of packaging material from the end surface to permit access to the contents, as by unfolding of a corresponding portion of an inner wrapper of packaging material.

10 Claims, 7 Drawing Figures

PACKAGING

This invention relates to packaging or cigarettes or the like in packages having rectangular access end surfaces, especially wherein an access end closure is formed with external means for opening it.

Currently, most soft packages for cigarettes or the like have a rip tape surrounding the sidewalls thereof adjacent a rectangular access end surface, the tape underlying an outer sheath of packaging material except at one end, which may be gripped and pulled to sever the end portion of the sheath from the rest thereof, whereupon an inner wrapper may be opened as by unfolding to provide access to the contents. Alternatively, pull strips secured to an enfolded portion of the access end surface of such a package have facilitated access to the contents, as in my U.S. Pats. Nos. 2,415,117 and 2,625,755; and center pull tabs as in my U.S. Pats. Nos. 2,845,213 and 2,923,110. The rip tape has the disadvantage of destroying the moisture seal over essentially an entire access end surface, and both the pull strips and the pull tabs are difficult of assembly and use.

A primary object of the present invention is improved application of access pull tabs to cigarette packages or the like.

Another object is adaptation of cigarette packages for pull tab access to the contents.

A further object is provision of a novel readily opened cigarette package.

Other objects of this invention, together with means and methods for attaining the various objects, will be apparent from the following description and the accompanying drawings of a preferred embodiment thereof, which is presented by way of example rather than limitation. The first half dozen views are in perspective, and the last one in side elevation.

In general, the objects of the present invention are accomplished, in the packaging of cigarettes or the like in packages having rectangular access end surfaces, by positioning a plurality of such packages sequentially with wide side edges of such end surfaces of adjacent packages mutually contiguous, applying a strip of pull material to the end surfaces from one wide side edge to the other of each such package in sequence and effecting adherence of the strip to the packages. The resulting cigarette package preferably comprises a rectangular access end surface covered by an inner wrapper folded thereover and by an outer sheath overlying the wrapper, with an arcuate slit extending substantially across the end surface from one wide side edge to the opposite side edge about one-third of the length thereof from one narrow side edge and curving theretoward, and a generally rectangular pull tab substantially covering the portion of the end surface bounded by the narrow end, the slit, and the intervening segments of the wide side edges, the pull tab adhering to such end portion and covering and sealing the slit and terminating in a non-adherent pull portion.

Figure 1:
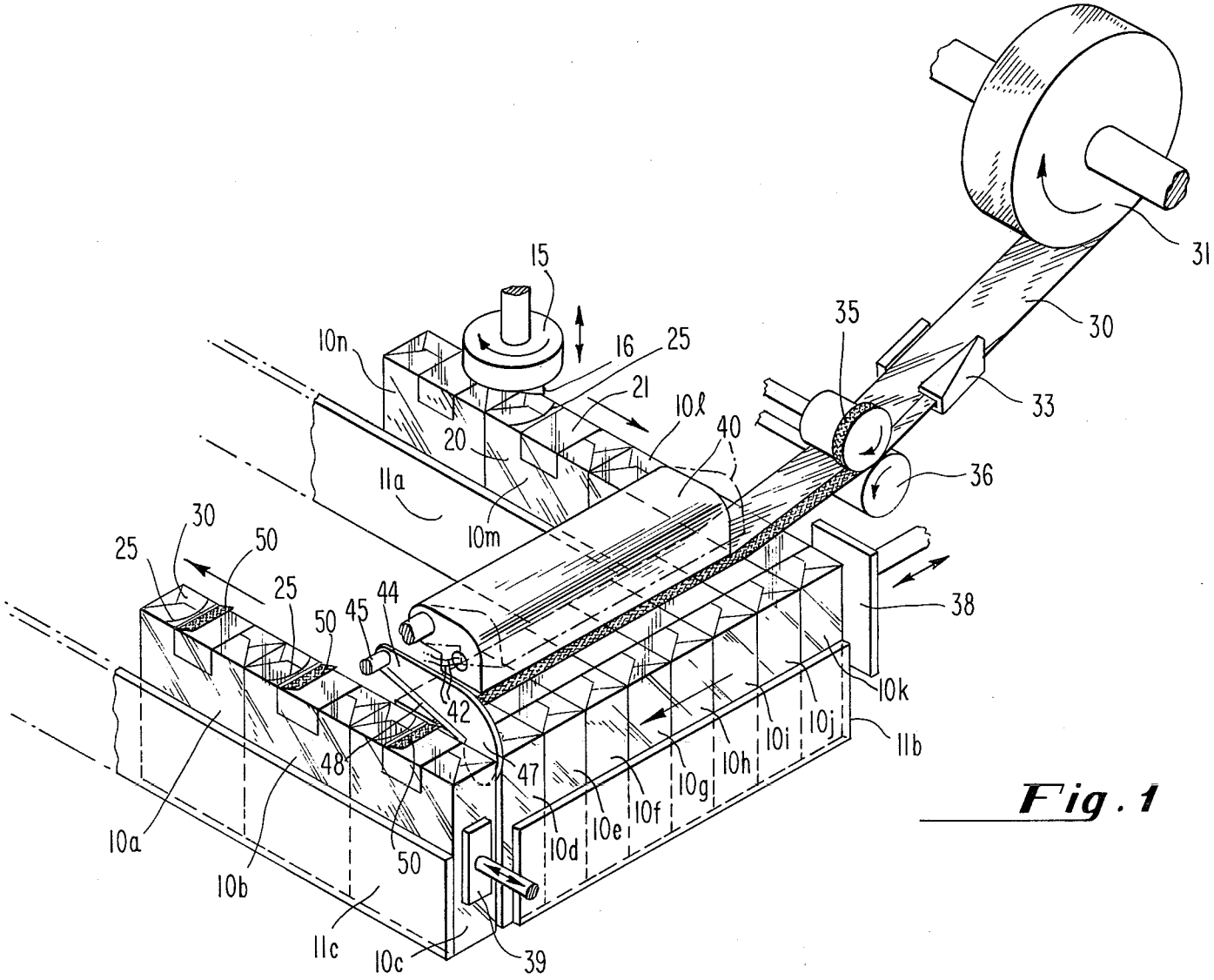
FIG. 1 shows schematically the treatment of cigarette packages in the practice of the present invention.

FIG. 1 shows numerous cigarette packages being treated according to the present invention. Each package is conveyed through a pathway that is U-shaped as viewed from above, the packages entering at the top of the righthand arm of the pathway, travelling from the bottom of that arm across the base from right to left, and then proceeding up the lefthand arm of the pathway. The packages are designated 10*a* to 10*n* in reverse sequence, i.e., from the top of the lefthand arm to the top of the righthand arm of the U-shaped pathway, package 10*a* being the first and package 10*n* the last appearing in such pathway. The pathway is defined by upstanding guides flanking the packages; only guide 11*a* on the left side of the righthand arm, guide 11*b* on the bottom of the base, and guide 11*c* on the left side of the lefthand arm are visible in this view, being designated in the order of travel (intermittent) of the packages along the pathway.

Poised above last illustrated package 10*m* is rotating knife support 15 with inverted ramplike knife 16 just visible depending therefrom. The package itself is covered by outer sheath 20 folded thereabout and bonded together to form a moisture barrier. Stamp 21 covers substantially the centermost one-third of the top end surface of the package underneath the outer sheath and extends a short distance down along the wide side panels, usually covered by a cuplike label, and is secured adhesively thereto. The rotating knife support is reciprocated up and down, as indicated by the adjacent double-ended arrow, into and out of slitting contact with successive package tops. The reciprocation is timed so that the package is stationary in its path when being slit by the knife.

Package 10*m*, as well as all preceding packages, exhibit arcuate slit 25 in outer sheath 20 covering the top end surface alongside an edge of stamp 21 and extending substantially from one wide side edge to the opposite side edge, curving toward the nearer narrow edge of the top. As will become apparent in later views, the arcuate slitting extends through the outer sheath and through an inner wrapper as well. Slit packages progress through the right-hand arm of the U-shaped path and then along the base, where the slitted top end surfaces are covered by a strip of pull material 30 having a face adapted to adhere thereto. Such strip material has the capability of bonding to itself or to the surface of a package wrapper or the like, as by being thermo-sensitive and heat-sealing thereto. Package 10n is unslit and is the next package to be slit by rotary knife 16 during a dwell in package travel.

Pull material 30 is carried on reel 31 and is unwound therefrom to pass through hemmer 33, which turns a marginal portion of one edge of the strip under and onto itself to juxtapose and bond it to the adjacent face. Then the strip passes through the nip of knurling roller 35 and backing roller 36 which may be heated internally or externally by suitable means (not shown) to facilitate such bonding. Finally the strip passes under tamper 40, which overlies half dozen packages 10*e* to 10*j* from the far narrow edge of the visible end surface to about the stamp edge near thereto.

The packages travel intermittently along the U-shaped pathway, as suggested by push plate 38 located near the right corner and directed leftward along the base, and as suggested by push plate 39 located near the left corner and directed upward along the lefthand arm. Tamper 40 is raised (broken lines) from the top surface of the packages during package travel and descends to press intervening strip 30 of pull material thereonto only during dwell periods in such intermittent travel. Package travel between dwells equals one of the lateral dimensions of the package top. Previous descents of the tamper, here shown in the down position, have applied the strip of material to the top of the packages then thereunder, so package 10*j* and all previous packages have had such strip adhered thereto. However, package 10*k*, which has just moved to the right corner of the pathway has not, and strip 30 extends obliquely thereabove to the right of the tamper.

At the left end of tamper 40, pair of leads 42 enter an opening to interconnect to an optional electrical resistance heating element (not visible) therein for use with thermo-sensitive strip material. Alongside but spaced from that end of the tamper, cutting member 44 carried on rocker arm 45 is aligned with the mutually contiguous wide side edges of package 10*d* in the base of the pathway and package 10*c* at the left corner, neither of such packages being under the tamper. This cutting member has at its free end spacer head 47 and along its intermediate lower surface knife edge 48. The spacer head has a wedge-like lower edge, which enters between the adjacent packages at the near third of the package top, and the knife edge begins before reaching the pull material, which is severed thereby as the knife edge descends. The next intermittent movement of the packages pushes package 10*c*, now with pull tab 50 formed thereon from the severed strip of pull material up the lefthand arm of the U as package 10*d* moves into position to have the strip severed at the other edge of its top surface. The knurled free edge of the tab freely overlies part of the stamp and is available to be gripped for opening.

Figure 2:
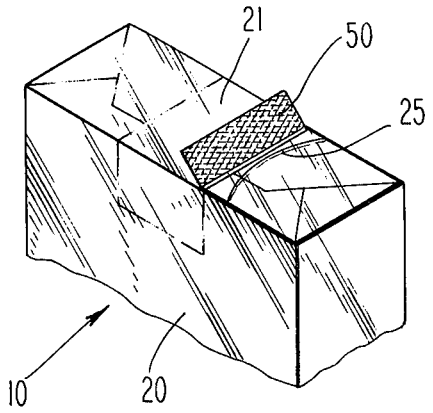
FIG. 2 shows a finished package after such treatment.

FIG. 2 shows such completed cigarette package 10 with pull tab 50 having its knurled marginal portion upstanding in position to be gripped. Arcuate slit 25 in the folded flaps of outer sheath 20 is visible underlying the transparent body portion of the pull tab, which covers it and the righthand one-third or so of the rectangular package top from the edge of stamp 21 (which covers the central one-third of the top) to the next narrow edge of the top and from one wide side edge to the other therebetween.

Figure 3:
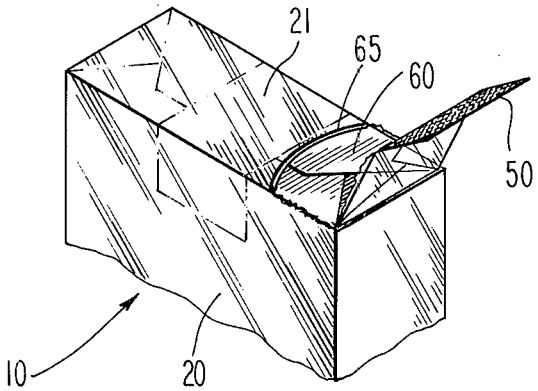
FIG. 3 shows a preliminary stage in the opening of such package.

FIG. 3 shows the same package with its access closure in the process of being opened, as the knurled marginal portion of the pull tab has been gripped and pulled to lift the tab from the package top along with the underlying portion of the outer sheath, which has torn from the ends of slit 25 along the wide side edges to the narrow side edge, where it is shown still intact. Slit 65 is shown in underlying folded flaps of inner wrapper 60, which is shaded to suggest metallic foil.

Figure 4:
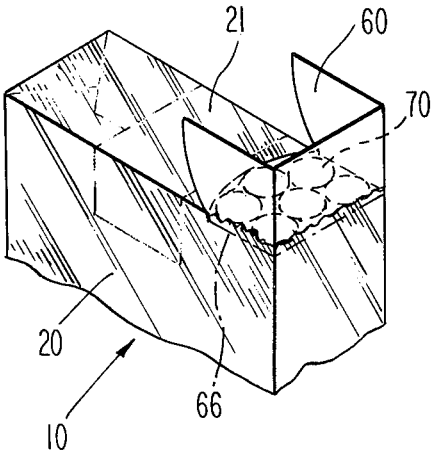
FIG. 4 shows a later stage in the opening of such package.

FIG. 4 shows the package after complete removal of the pull tab and adherent outer sheath portion, no longer shown. The visible portion of inner wrapper 60 is unfolded into an upstanding spout-like configuration, revealing contents 70 therein in the form of a plurality of cigarettes. Broken line 66 visible just below the top edge of the package walls about the access opening denotes an optional line of weakness in the inner wrapper (like line 27 in inner wrapper 20 of my U.S. Pat. No. 3,276,668, as in FIG. 2 thereof). In its absence the inner wrapper will tear off much like the removed portion of the outer sheath though usually more raggedly, rather than smooth as shown here.

Figure 5:
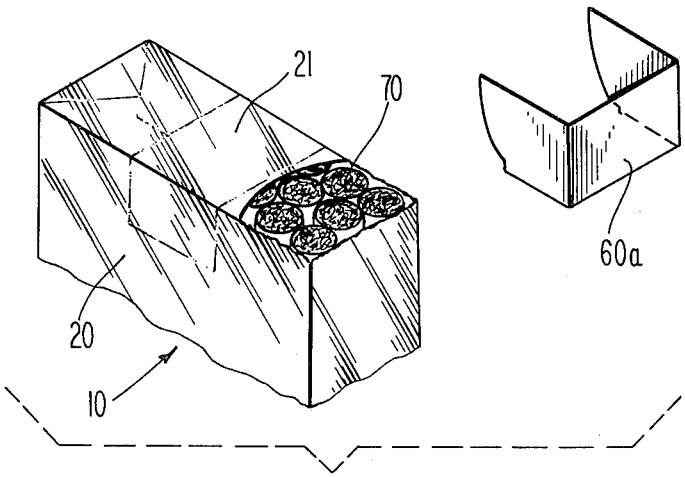
FIG. 5 shows such package fully opened.

FIG. 5 shows spoutlike portion 60*a* of the inner wrapper 60 disengaged from the rest of the package, revealing contents 70 more fully. Such removal is an alternative to refolding thereof after removal of one or more of the cigarettes contained therein. In either event coverage of the remaining two-thirds or so of the package is not disturbed, as the outer sheath remains enfolded thereover and bonded together. Retention of the latter in place prolongs freshness of the contents by limiting exposure thereof to the atmosphere and permits elimination of the stamp while providing an adjacent edge to assist in holding the flaps of the inner wrapper in the reclosed position if desired.

Stamp 21, which is not slit according to this invention, is not necessary and is shown here merely as a matter of convention but may be omitted entirely or may be replaced by a label portion overlying the two-thirds of the top surface of the inner wrapper not removed (and underlying the part of the outer sheath similarly left in place). In the absence of the stamp (or any extension of the so-called label) the visible top end surface of the folded inner wrapper may serve a product identification function, as by having a brand name embossed thereon.

The practice of this invention does not interrupt the conventional packaging procedure for cigarettes or like articles. Instead it merely adds thereto at the end of the line simple steps and machinery as disclosed herein to complete the packages by incorporating simple but effective access closure means. Of course, the conventional steps and machine components for inserting a rip tape are omitted from the packaging line, along with the tape itself. Suitable timing, drive interconnection, and materials of construction for the simple machinery so utilized according to this invention will be apparent to persons ordinarily skilled in the packaging art without further details.

The ease of package opening is a convenience for the user just as the simplicity of packaging is a benefit and an economy for the packager. This invention eliminates the disadvantages of prior pull strip or pull tab packages and packaging while avoiding the usual approach of complicating matters. Instead, this invention represents unobvious refinement in packaging, especially suited to the cigarette industry but also appropriate for use in packaging of like articles.

Figure 6:
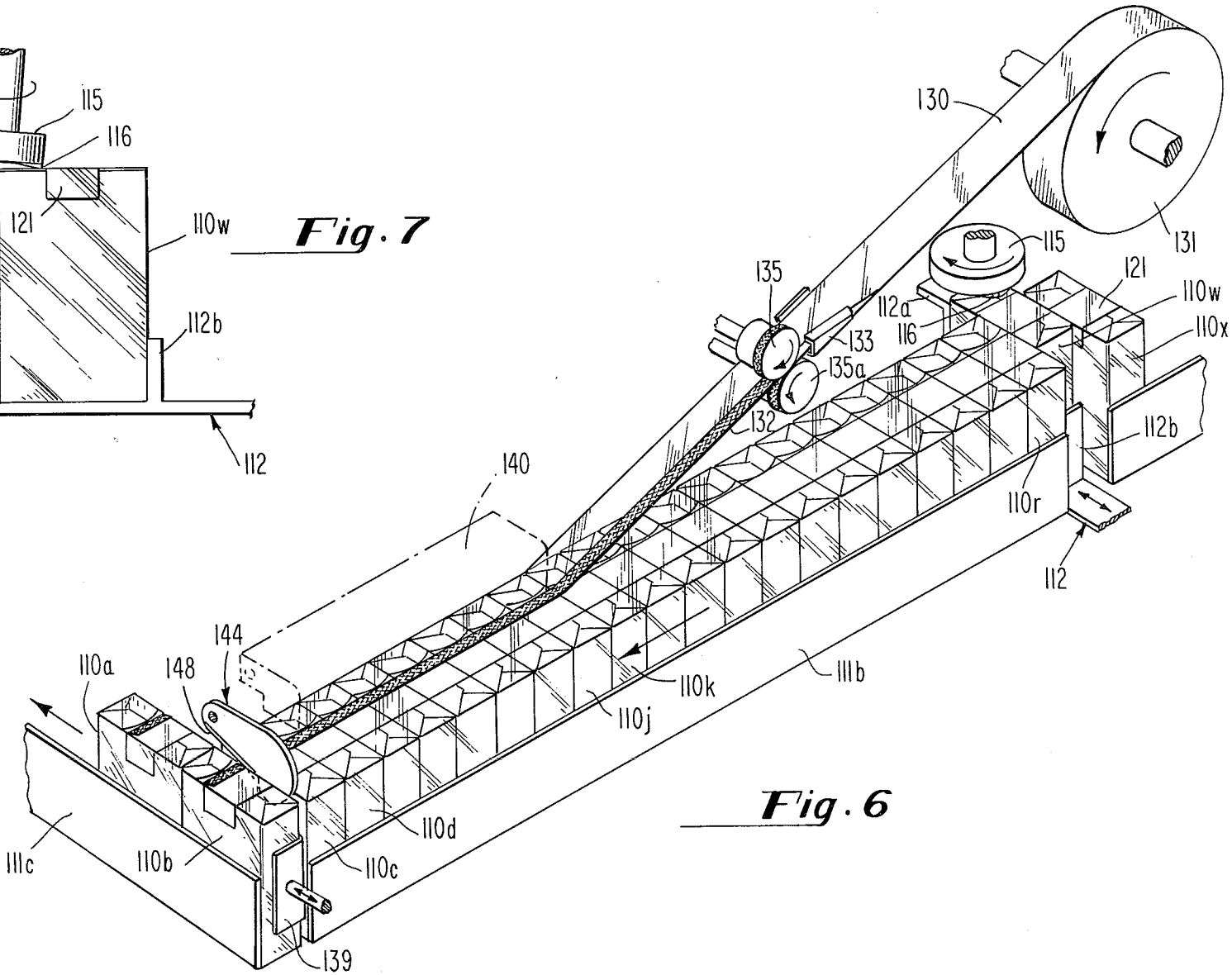
FIG. 6 shows another embodiment of treatment of cigarette packages according to this invention.

FIG. 6 shows numerous cigarette packages being treated according to this invention in a more nearly unidirectional configuration than the U-shaped pathway shown previously. However, this one also has an arm at the left along which the completed packages are pushed after being treated similarly to those in FIG. 1. Many of the reference numerals are denoted as being larger by 100 than those denoting like features in FIG. 1 and will be so understood without special mention. Completed packages 110*a* and 110*b* are shown in the left leg. Cutting member 144 is shown entering between packages 110*b* and 110*c* to cut pull strip 130 into individual pull tabs 150, as on package 110*a*. Push plate 139 has a wedging flange (not visible) at its right vertical edge to assist in spacing the packages for such cutting. Tamper 140 (shown in phantom) overlies a group of the packages, located side-to-side, to which the pull strip has been applied. Pair of knurling rollers 135, 135*a* knurl hemmed marginal portion 132 of pull strip material 130, which conveniently is pressure-sensitive on its under face so that it self-adheres and will adhere to the outer wrapper of the package without the necessity of being heated.

The chief modification lies in the rest of the path, where guide 111 is divided for the width of a cigarette package by slide 112, which has front and rear upstanding guide portions 112*b*, 112*c*. This slide, upon which package 110 is shown, displaces successive packages laterally (during a dwell period in the regular package travel) to locate them individually against stop 112*a* at the rear and under rotary knife 116 on support 115, which then descends to slit the upper package surface. Shown unslitted to the right, as the last package in the illustrated sequence, is package 110*x*. The slide returns each slit package into alignment with the path of travel during such dwell period.

Figure 7:
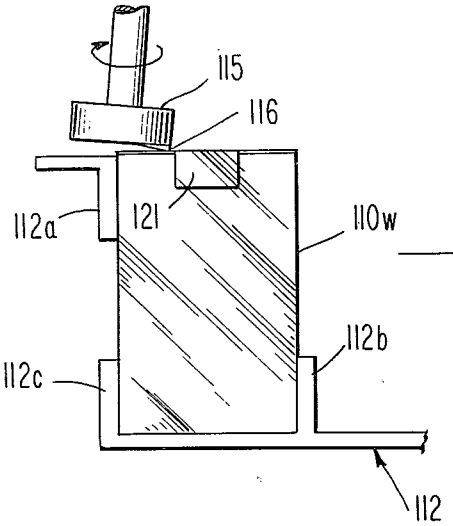
FIG. 7 shows a package with rotary knife applied to the top end surface thereof in the course of such treatment.

FIG. 7 shows slide 112 in side elevation with package 110w thereon and with rotary knife 116 in slitting contact with the package top. The relationship between knife and the layers of material making up such access end of the package is as in the embodiment shown in FIG. 1. Both outer sheath and inner wrapper are slit alike.

Although a preferred embodiment of the package of this invention and a plurality of embodiments of package flow paths have been described, modifications may be made therein, as by adding, combining, or subdividing parts or steps, while retaining substantial advantages and benefits of the invention, which itself is defined in the following claims.

I claim:

1. Cigarette package comprising a rectangular access end surface covered by an inner wrapper folded thereover and by an outer sheath overlying the wrapper, with arcuate slits in superposition extending through both wrapper and sheath substantially across the end surface from one wide side edge to the opposite wide side edge about one-third of the length thereof from one narrow side edge and curving theretoward, and a generally rectangular pull tab substantially covering the portion of the end surface bounded by the narrow end, the slit, and the intervening segments of the wide side edges, the pull tab adhering to such end portion and covering and sealing the slit and terminating in a non-adherent pull portion adjacent the slit.

2. Cigarette package according to claim 1, including a stamp extending from one side edge to the opposite side edge and covering an intermediate one-third of the end surface, one side edge of the stamp lying adjacent the slits in the wrapper and sheath without lapping them and underlying the pull portion of the pull tab.

3. Cigarette package according to claim 1, wherein the inner wrapper has a line of weakness adjacent the narrow side edge and wide side edge segments but spaced into adjacent wall portions of the wrapper, thereby defining with the slit therein a portion of the wrapper removable subsequent to removal of the pull tab and adherent portion of the outer sheath.

4. In the packaging of cigarettes or the like in successively produced packages comprising an inner wrapper and an outer sheath sealed thereover across rectangular access end surfaces thereof, the improvement in providing for access to the contents comprising simultaneously slitting both the outer sheath and the inner wrapper of each successive package across such end surface substantially from one wide side edge to the opposite wide side edge thereof, applying an adherent strip of pull material over the slits in successive packages with the packages aligned with the wide side edges of such surfaces of successive packages mutually contiguous, and severing the strip between successive packages to leave the slits in the sheath of each such package covered and sealed with an individual pull tab.

5. Packaging method according to claim 4, including the steps of forming a non-adherent margin along one edge of the strip of pull material before applying it to the packages and orienting the strip to cover the slits and to extend substantially to one narrow edge of such surface with the non-adherent margin at the edge thereof furthest from such narrow edge.

6. Packaging method according to claim 4, wherein one side of the strip of pull material is pressure-sensitive, and adherence of it to the package end surface is effected by pressing it thereagainst.

7. Packaging method according to claim 4, wherein one side of the strip material is thermo-sensitive, and adherence of it to the package end surface is effected by pressing it thereagainst and heating it while in contact therewith.

8. Packaging method according to claim 4, wherein the strip of pull material has an adherent face and a non-adherent face, and such marginal portion thereof is formed by folding the adherent face inward onto itself to laminate a double layer of such marginal portion together and leave the non-adherent face outward on both sides thereof as a pull.

9. Packaging method according to claim 4, wherein the adherent strip is severed by being knifed through between the successive packages in the sequence.

10. Packaging method according to claim 5, including spacing the successive packages apart sufficiently just before being severed to admit knifing means therebetween.

* * * * *